US005409398A

United States Patent [19]

Chadbourne et al.

[11] Patent Number: 5,409,398

[45] Date of Patent: Apr. 25, 1995

[54] LIGHTED ELECTRICAL CONNECTOR ADAPTER

[75] Inventors: Richard Chadbourne, Anaheim; Robert A. Miller, Anaheim Hills; Donald F. Worden, Orange; Thomas C. Zinchuk, LaMiranda, all of Calif.

[73] Assignee: Molex Incorporated, Lisle, Ill.

[21] Appl. No.: 78,879

[22] Filed: Jun. 16, 1993

[51] Int. Cl.[6] ..... H01R 13/66

[52] U.S. Cl. ..... 439/490; 439/488; 439/620

[58] Field of Search ..... 439/74, 76, 620, 638, 439/488, 489, 490

[56] References Cited

U.S. PATENT DOCUMENTS

| | | | |
|---|---|---|---|
| 4,258,968 | 3/1981 | Holt | 439/490 |
| 4,368,363 | 1/1983 | Ahuja | 439/620 |
| 4,431,251 | 2/1984 | Krantz | 439/620 |
| 4,875,152 | 10/1989 | Foster | 439/490 |
| 5,062,807 | 11/1991 | Guss, III | 439/490 |
| 5,217,391 | 6/1993 | Ho | 439/620 |

OTHER PUBLICATIONS

Crouse-Hinds Publication Entitled: "Mini Line With Indicating Lights" (P. 7).

Crouse-Hinds Publication Entitled: "LED Connectors DIN Standard" (p. 15).

Daniel Woodhead Publication Entitled: "LED Micro Change Connectors" (p. 13).

*Primary Examiner*—Larry I. Schwartz
*Assistant Examiner*—Hien D. Vu
*Attorney, Agent, or Firm*—Stacey E. Caldwell

[57] ABSTRACT

A lighted adapter for use in an electrical system which includes a male connector and a mateable female connector connectable in a given line circuit. The connectors include complementary interengaging terminals. The adapter includes a housing having a female end for mating with the male connector and a male end for mating with the female connector. An electronic package is located within the housing and includes adapter terminals for engagement with the terminals of the connectors when the housing is mated between the connectors, whereby the electronic package is electrically coupled to the line circuit through the adapter. A light source is provided in the housing and coupled in the circuit therethrough. A light transmitting lens is associated with the housing and arranged in proximity to the light source to provide external viewing of a lighted condition of the light source and, thereby, a line circuit condition through the adapter.

9 Claims, 4 Drawing Sheets

LIGHTED ELECTRICAL CONNECTOR ADAPTER

FIELD OF THE INVENTION

This invention generally relates to the art of electrical systems and, particularly, to a lighted electrical connector adapter for connection between a pair of mating electrical connectors to indicate a circuit condition through the connectors.

BACKGROUND OF THE INVENTION

Lighted electrical connectors often are used in various applications to give a ready visual indication of a circuit condition through the connectors or a condition of an electrical component with which the connectors are coupled in line. The connectors may be used simply to indicate the existence of a current therethrough. In other words, as long as the line circuit is viable, the connectors will remain lighted. If a failure occurs in the line circuit, the lighted connectors will not be energized and, thereby, give a ready visual indication of a line circuit failure.

Such lighted connectors also are used with other types of electrical packaging, i.e. other than for indicating a simple on-off condition. The lighted connectors are used to verify operation or locate a malfunction in applications using proximity switches, limit switches, solenoid valves and the like. The lighted connectors display the status of each of these control components and thereby provide for control system maintenance and troubleshooting. For instance, a lighted connector for a solenoid-actuated valve can give an operator a continuous visual indication of whether the valve is in an extended or retracted state. A light source of one color in the connector may indicate an extended condition of the valve, while another colored light source can indicate a retracted condition of the valve. If the valve loses power, locks in one of the positions, or ceases to operate for any other reason, the operator is able to quickly identify the problem, making control system maintenance and troubleshooting much easier.

Lighted connectors often are used in automotive and industrial applications for troubleshooting on control and sensing devices in automated production lines. Two light emitting diodes (LED's) typically are used in a given lighted connector. A green power LED indicates power to the device, and a red or yellow load LED indicates an operating status of the device. The sensing device may be mechanical, electrical or optical, and, for example, may "sense" the presence or absence of a component on a production line. Such indicating lights may identify a defective sensor or control device and speed-up the troubleshooting process, thereby reducing the down-time of the production line. In some applications, indicating lights are included on the device itself. This is quite costly because the indicating means is lost when the device, itself, is removed. Therefore, such light indicating means have been incorporated in electrical connectors coupled in the line circuit to the device.

One of the problems in using lighted electrical connectors of the character described above is that the cost of such connectors are relatively high. In other words, any given electrical connector is designed to include various features, capabilities or parameters to fulfill the connecting functions for which the connector is being used. Adding a light indicating system within the connector adds considerably to the cost of the connector and, when such a connector becomes defective, the entire apparatus must be replaced. In addition, many electrical systems are set up without any light indicating means whatsoever, and it can be expensive to replace the existing electrical connectors with light indicating connectors.

This invention is directed to solving the above problems by providing a lighted electrical connector adapter which can be placed in-line between a pair of existing electrical connectors to perform a light indicating function without having to replace or redesign the connectors themselves. The adapters may be designed with various standard mating ends for coupling in-line with various standard electrical connectors.

SUMMARY OF THE INVENTION

An object, therefore, of the invention is to provide a lighted electrical connector adapter of the character described.

In the exemplary embodiment of the invention, the lighted electrical connector adapter is designed for use in an electrical system which includes a male connector and a mateable female connector connectable in a given line circuit. The connectors include complementary interengaging terminals. The lighted adapter includes a housing having a female end for mating with the male connector and a male end for mating with the female connector. Therefore, any pair of mating connectors in a given electrical system simply can be uncoupled, and the lighted adapter coupled between the connectors without in any way changing the connectors themselves.

The lighted electrical connector adapter of the invention includes an electronic package within the housing including adapter terminals for interengagement with the terminals of the male and female connectors when the housing is mated between the connectors, wherein the electronic package is electrically coupled to continuation of the line circuit through the adapter. A light source is provided in the housing in the electronic package. Generally, light-transmitting lens material is associated with the housing and arranged to provide external viewing of a lighted condition of the light source.

In order to obviate the provision of a separate light-transmitting lens, at least a portion of the adapter housing is fabricated of light-transmissive material to form the lens. As disclosed herein, at least a 360° portion of the housing is fabricated of light-transmissive material to provide external viewing from any normal direction about the adapter. The 360° portion projects transversely or radially outwardly of the housing to provide external viewing from any axial direction from the adapter. In the preferred embodiment of the invention, the housing, itself, is substantially entirely fabricated of the light-transmissive material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
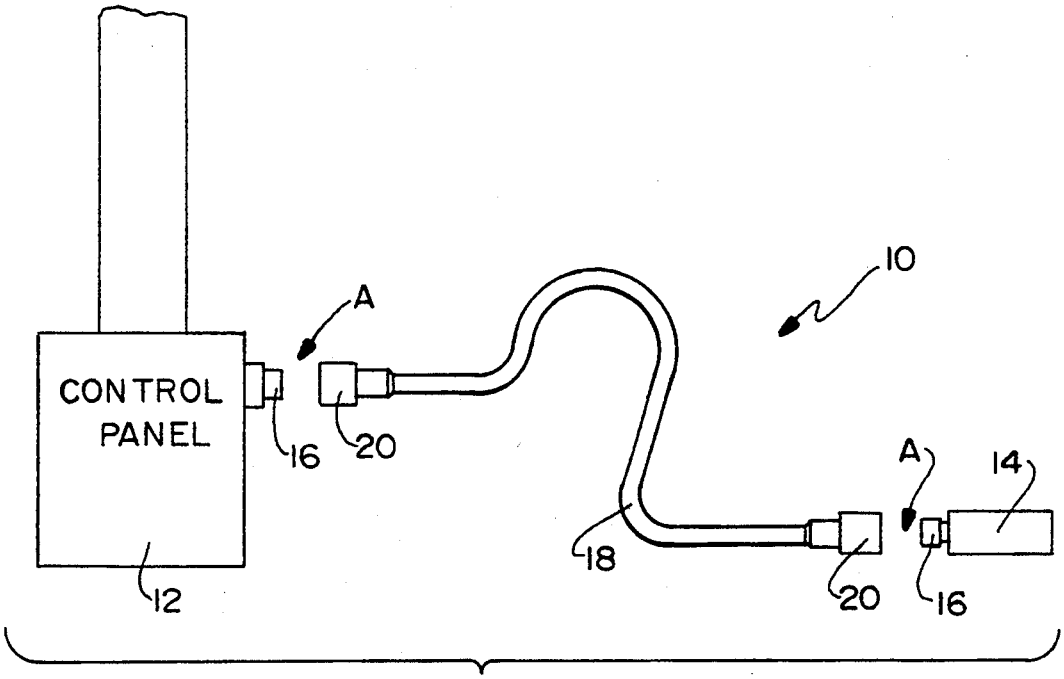
FIG. 1 is a somewhat schematic view of an electrical system with which the electrical connector adapter of the invention is applicable.

Referring to the drawings in greater detail, and first to FIG. 1, the invention has a wide range of applications and has a particularly advantageous use in retrofitting an existing electrical system to include light indicating means, without in any way changing the existing components of the system. For instance, FIG. 1 shows an electrical system, generally designated 10, which includes a control panel 12 at one end of the system and a remote sensor 14 at an opposite end of the system. For instance, the sensor may be an electrical component in an automated production line. A receptacle or female connector 16 is mounted on control panel 12, and sensor 14 also may include a receptacle or female connector 16. An electrical line 18 has a plug or male connector 20 on each end thereof for electrical connection with receptacle connectors 16. Of course, the plug and receptacle connectors may be reversed at either end of line 18. In other words, sensor 14 may have a plug connector 20 thereon, with the right-hand end of line 18 having a receptacle connector 16.

In order to retrofit electrical system 10 (FIG. 1) to provide a light indicating system, according to the concepts of the invention, an adapter (described hereinafter) may be inserted between the mating connectors 16,20 at either location indicated by arrows "A". Therefore, it immediately can be seen that all connecting components of existing system 10, i.e. electrical connectors 16 and 20, remain unchanged. If system 10 were to be revised using lighted electrical connectors of the prior art, either the connector 16 on control panel 12, or the connector 16 on sensor 14, or the connector on either end of line 18, or the entire line would have to be changed and/or replaced with one or more lighted connectors.

Figure 2:
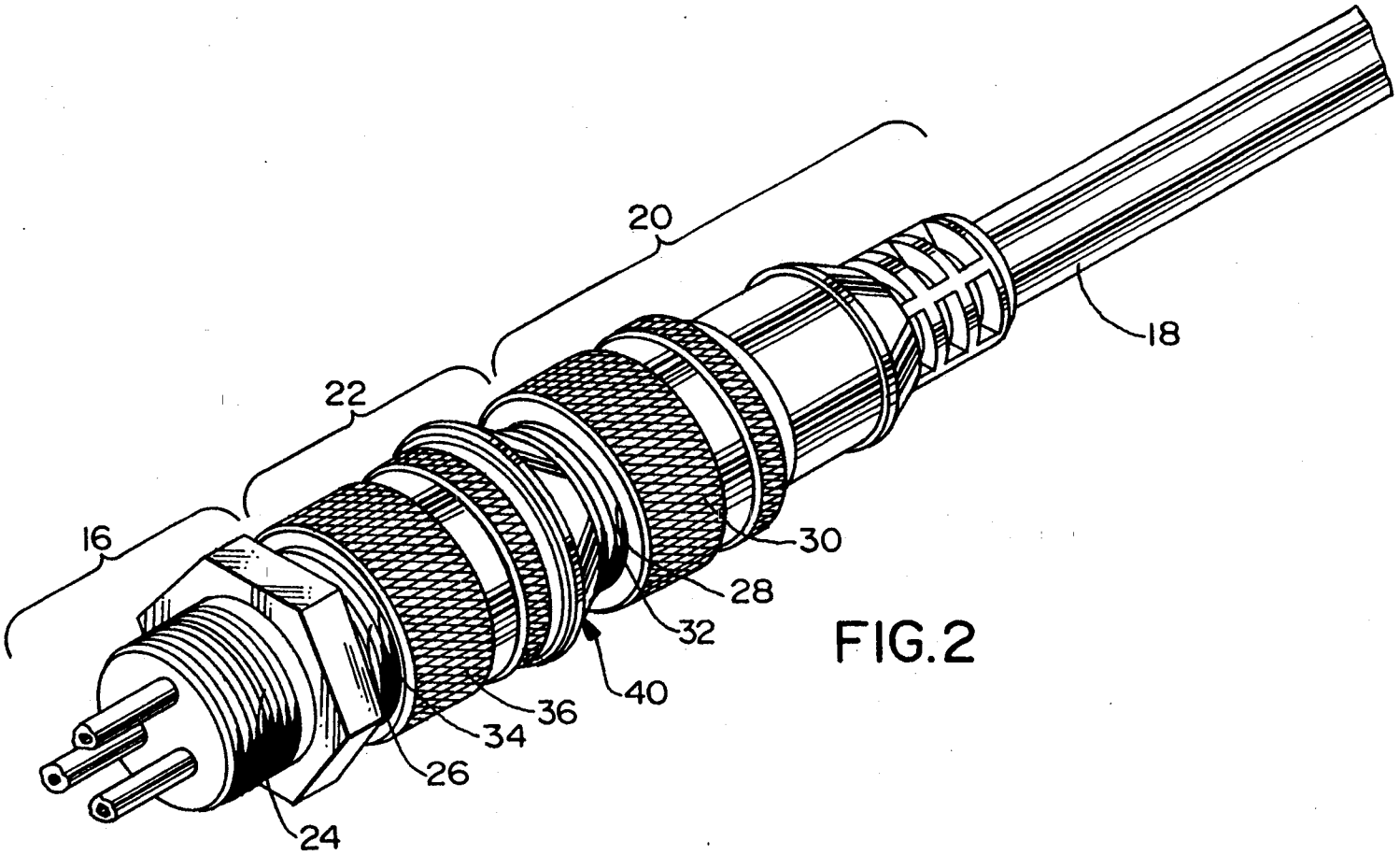
FIG. 2 is a perspective view of the adapter of the invention coupled in-line between a pair of mating connectors.

FIG. 2 shows a lighted electrical connector adapter, generally designated 22, coupled between one of the receptacle connectors 16 and plug connectors 20 as described above in relation to FIG. 1. Receptacle connector 16 in FIG. 2 may have an externally threaded end 24 for mounting to control panel 12 (FIG. 1) and plug connector 20 is shown terminated to line 18. Receptacle connector 16 has an externally threaded end 26 and plug connector 20 has an internally threaded end 28 defined by a coupling ring 30. Correspondingly, lighted adapter 22 has an externally threaded end 32 and an internally threaded end 34 defined by a coupling ring 36. In other words, the opposite coupling ends of lighted electrical connector adapter 22 are complementary to the coupling ends of electrical connectors 16 and 20.

Before proceeding with a detailed description of lighted electrical connector adapter 22, it should be understood that the use of the terms "male" connector or mating end and "female" connector or mating end herein and in the claims hereof are not to be construed as limiting. Most electrical connectors are designed with mating male and female ends of some form or another. The mating interconnections may be internal-/external threaded connections as shown herein and described above. However, a wide variety of interconnections are contemplated by the invention, such as, but not limited to, bayonet-and-pin connections, snap-latch connections, slide connections, and the like.

Figure 3:
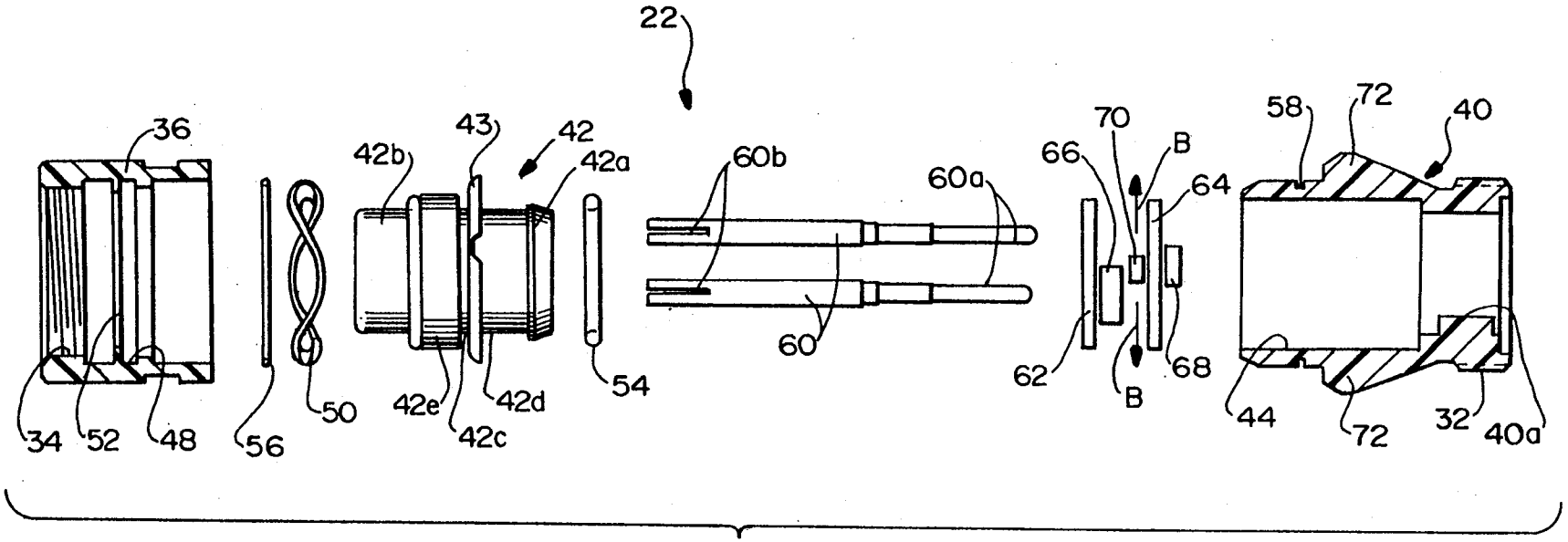
FIG. 3 is an exploded view of the components of the adapter, the housing and the coupling ring being in section and the remaining components being in elevation.
Figure 4:
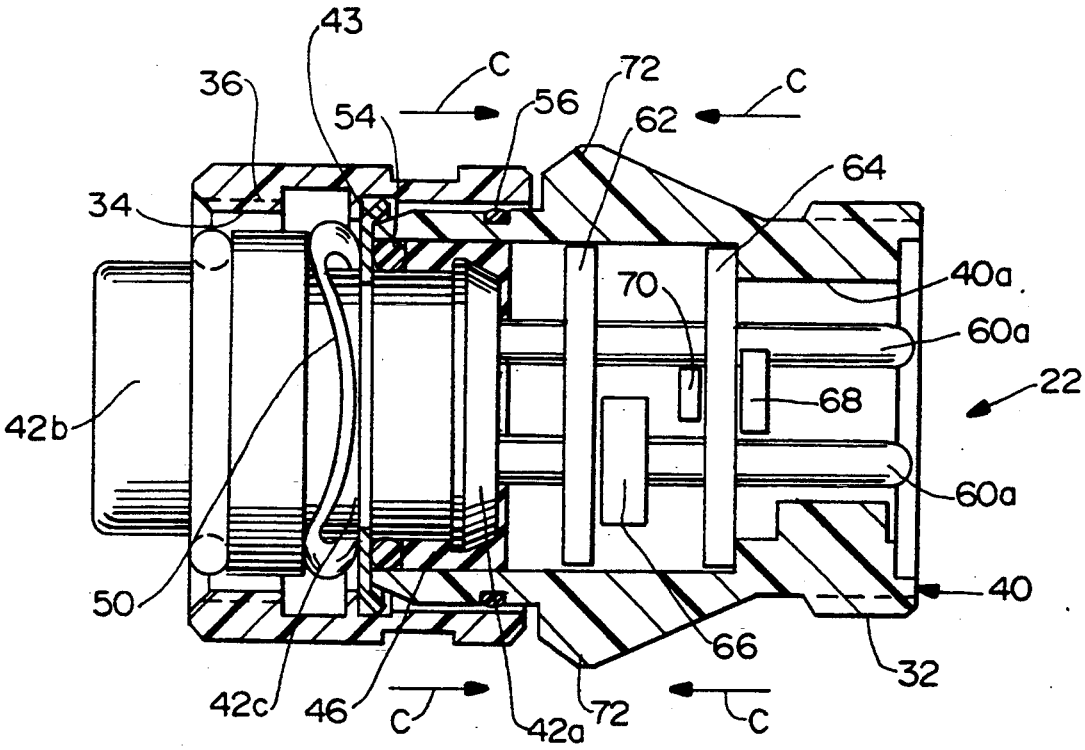
FIG. 4 is an axial section through the housing and the coupling ring of the adapter in assembled condition.
Figure 5:
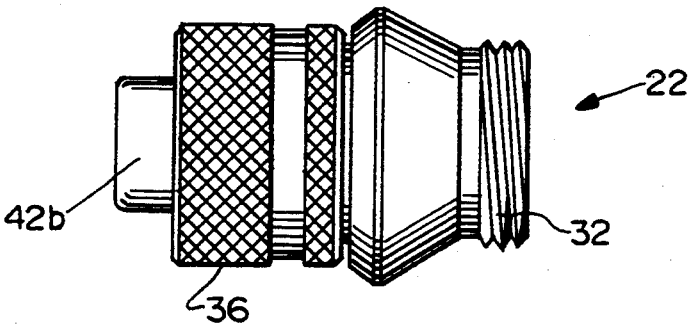
FIG. 5 is an elevational view of the assembled adapter.

With that understanding, reference is made to FIGS. 3 and 4 wherein coupling ring 36 is shown at the left of those depictions, the coupling ring having internally threaded mating end 34. The coupling ring is part of an adapter assembly which includes a housing member, generally designated 40, which has the aforementioned externally threaded coupling end 32 at the right-hand end in the figures. Housing member 40 has a receptacle or female mating end 40*a* for mating with plug or male connector 20. A dielectric housing insert, generally designated 42, is mounted co-extensively within the assembled housing member 40 and coupling ring 36. A right-hand end 42*a* of insert 42 projects within an interior cavity 44 of housing member 40 and is retained therewithin by a potting compound 46 (FIG. 4). Housing insert 42 has a plug mating end 42*b* for insertion into receptacle connector 16 (FIG. 2). Housing insert 42 is molded of plastic material and includes a circumferential retaining washer 43 which snaps into an interior circumferential groove 48 of coupling ring 36 to hold the coupling ring in assembly as shown in FIG. 4, but to allow the coupling ring to freely rotate in order to mate the adapter with externally threaded mating end 26 (FIG. 2) of receptacle connector 16. A wave spring 50 is adapted to fit over plug mating end 42*b* so that in assembly, when retaining washer 43 snaps into circumferential groove 48 the wave spring 50 is in an internal circumferential groove 42*c* of insert 42 between the plastic shoulder 42*e* and the retaining washer 43. This arrangement spring loads the coupling ring 36 about the housing insert 42 to hold the insert positively and without axial movement within the coupling ring while still allowing the coupling ring to rotate upon mating the adapter to an externally threaded mating end 26, as stated above. Lastly, a sealing O-ring 54 is effectively located between insert 42 and the interior wall 44 of housing member 40 to seal the interior of adapter 22 from the exterior environment. Finally, an indicating O-ring 56 is effectively located in a groove 58 on the outside of the housing member and the inside of coupling ring 36 to indicate the coupling status of the mating ends.

The electronic packaging within adapter 22 includes three adapter through-terminals 60 having pin ends 60*a* and socket ends 60*b*. The adapter terminals may include a ground contact as shown and labeled as "G" in FIG. 6. The pin ends are interengageable with appropriate socket terminal means within plug connector 20 and the socket ends are interengageable with appropriate pin terminals within receptacle connector 16. The pins extend through a pair of printed circuit boards 62 and 64. A resistor 66 is mounted to the inside of circuit board 62 and coupled to circuit traces thereon. A blocking diode 68 is mounted to the outside of circuit board 64 and coupled to circuit traces thereon. A light source in the form of a light emitting diode (LED) 70 is mounted to the inside of circuit board 64 and coupled to circuit traces thereon.

Figure 6:
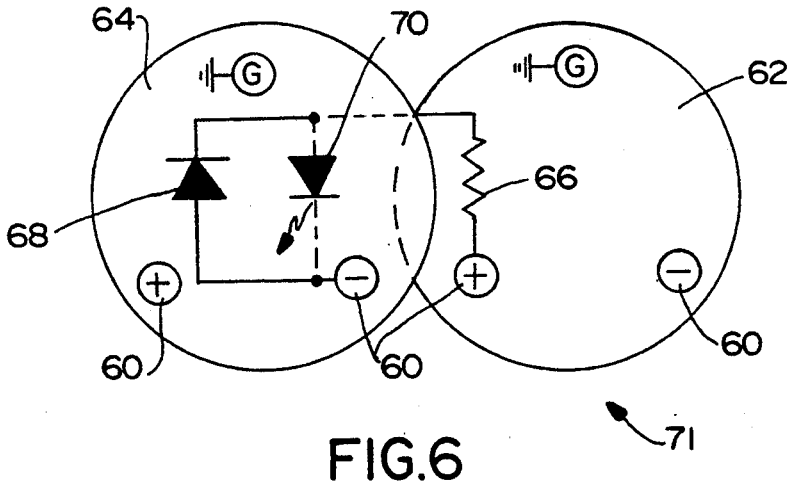
FIG. 6 is a schematic illustration of one type of electronic package within the adapter.

FIG. 6 shows a schematic illustration of a circuit means 71 including adapter terminals 60, circuit boards 62 and 64, resistor 66, blocking diode 68 and LED 70. It can be understood that the electronic package of adapter 22 is a simple package to indicate the viability of a line circuit through the adapter and electrical connectors 16 and 20. In other words, if electrical current is running from control panel 12 (FIG. 1) to sensor 14 through one of the mating pairs of connectors 16 and 20, along with adapter 22 as shown in FIG. 2, LED 70 will be energized and emit light radially outwardly therefrom in the direction of arrows "B" (FIG. 3). Of course, a wide range of electrical or electronic packaging can be incorporated in adapter 22, such as to perform functions as described in the "Background", above.

The invention contemplates that a light-transmitting lens means be operatively associated with housing 40 and in proximity to the LED to provide external viewing of a lighted condition of the LED and, thereby, a line circuit condition through adapter 22. Although a separate lens means could be used, the invention contemplates that the lens means be provided by at least a portion of housing 40 and be capable of transmitting light from the LED 360° radially or circumferentially about the adapter. To this end, housing 40 preferably is fabricated of light-transmissive material such as transparent molded plastic material. With LED 70 located generally centrally within the housing as seen in FIG. 4, external viewing is provided from any normal direction 360° about adapter 22. In addition, the housing is provided with an integrally molded ridge 72 which projects transversely outwardly of the housing circumferentially thereabout. Preferably, this ridge projects outwardly of the overall outside profile of the adapter as seen in FIG. 4. Therefore, external viewing is provided from any axial direction from the adapter as represented by arrows "C" in FIG. 4.

Therefore, it can be understood that a wide variety of electrical systems, such as system 10 in FIG. 1, can be modified or retrofit with a lighting means to indicate various circuit conditions without in any way changing the system or the components thereof. An adapter having opposite mating ends complementary to the mating ends of a pair of opposing electrical connectors allows the adapter to be coupled in line with the connectors and provide the prescribed electrical lighting characteristics. Although the electronic package illustrated herein, particularly in FIG. 6, is a simplified electronic package, it should be understood that much more sophisticated packages are contemplated by the invention, such as systems described in the "Background" above to indicate various states of various control components, such as proximity switches, limit switches, solenoid valves and a variety of other electrical components.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. For use in an electrical power system which includes a cylindrical male connector and a matable cylindrical female connector connectable in a given line circuit, the connectors including complementary interengaging terminals and complementary interengaging threaded ends, a lighted electrical connector adapter, comprising:

a housing having a cylindrical female end for mating with said male connector and a cylindrical male end for mating with said female connector;

an electronic package within the housing including adapter terminals mounted to internal circuit boards for interengagement with the complementary interengaging terminals of said connectors when the housing is coupled between the connectors, whereby the electronic package is electrically coupled to the line circuit through the lighted adapter;

a light source in the housing coupled to said electronic package to provide a visual indication of the presence of power within the system; and light-transmitting material associated with the housing and arranged in proximity to the light source to provide external viewing of a lighted condition of said light source, wherein a 360° portion of the housing is fabricated of the light-transmissive material to provide external viewing of the light source from substantially any normal viewing direction.

2. The lighted electrical connector adapter of claim 1 wherein said 360° portion projects transversely outwardly of the housing to provide external viewing from any axial direction from the adapter.

3. The lighted electrical connector of claim 2 wherein said housing means is substantially entirely fabricated of said light-transmissive material.

4. The lighted electrical connector of claim 1 wherein said light source comprises a light emitting diode.

5. For use in an electrical power system which includes a first cylindrical connector having a threaded mating end and a second cylindrical connector having a threaded mating end mateable with the threaded mating end of the first cylindrical connector in a given line circuit, the connectors including complementary interengaging terminals, a lighted adapter, comprising:

a housing having a first threaded end for mating with the threaded mating end of said first cylindrical connector and a second threaded end for mating with the threaded mating end of said second cylindrical connector;

an electronic package within the housing means including adapter terminals mounted to internal circuit boards for interengagement with the complementary interengaging terminals of said cylindrical connectors when the housing is coupled between the connectors, whereby the electronic package is electrically coupled to the line circuit through the adapter;

a light source in the housing coupled to said electronic package to provide a visual indication of the presence of power within the system; and light-transmitting material associated with the housing and arranged in proximity to the light source to provide external viewing of a lighted condition of said light source.

6. The lighted adapter of claim 5 wherein a 360° portion of the housing is fabricated of said light-transmissive material to provide external viewing of the lighted condition of said light source from any normal viewing direction about the adapter.

7. The lighted adapter of claim 6 wherein said 360° portion projects transversely outwardly of the housing to provide external viewing from any axial direction from the adapter.

8. The lighted adapter of claim 7 wherein said housing is substantially entirely fabricated of said light-transmissive material.

9. The lighted adapter of claim 5 wherein said light source comprises a light emitting diode.

* * * * *